US005212531A

United States Patent [19]

Monma et al.

[11] Patent Number: 5,212,531

[45] Date of Patent: May 18, 1993

[54] PRINTING POSITION ADJUSTMENT MECHANISM FOR PRINTER

[75] Inventors: Yoshio Monma, Ooi; Ikuo Negoro, Sakado, both of Japan

[73] Assignee: Asahi Kogaku Kogyo Kabushiki Kaisha, Tokyo, Japan

[21] Appl. No.: 681,746

[22] Filed: Apr. 8, 1991

[30] Foreign Application Priority Data

Apr. 10, 1990 [JP] Japan ..... 2-94420

[51] Int. Cl.[5] ..... G03G 21/00

[52] U.S. Cl. ..... 355/316; 101/234; 226/45; 242/57

[58] Field of Search ..... 355/308, 309, 316, 317, 355/208; 242/57; 226/45, 24, 10; 101/232, 233, 234, 235; 400/582, 622

[56] References Cited

U.S. PATENT DOCUMENTS

| | | | |
|---|---|---|---|
| 3,949,856 | 4/1976 | Ulber et al. | 197/133 R |
| 4,101,018 | 7/1978 | Sokolowski | 400/582 |
| 4,963,941 | 10/1990 | Negishi et al. | 355/282 |

FOREIGN PATENT DOCUMENTS

| | | |
|---|---|---|
| 0073132 | 3/1983 | European Pat. Off. . |
| 895296 | 5/1962 | United Kingdom . |
| 2026392 | 2/1980 | United Kingdom . |
| 2220891 | 1/1990 | United Kingdom . |
| 2232640 | 12/1990 | United Kingdom . |
| 2236714 | 4/1991 | United Kingdom . |

OTHER PUBLICATIONS

United Kingdom Search Report.

*Primary Examiner*—A. T. Grimley
*Assistant Examiner*—Christopher Horgan
*Attorney, Agent, or Firm*—Sandler, Greenblum & Bernstein

[57] ABSTRACT

In a printing position adjusting mechanism employed in an image forming apparatus using a continuous form recording medium having perforated tear lines at predetermined intervals, are sensors are provided for detecting a leading edge of the recording medium and outputting a predetermined signal synchronously with the feeding of the recording medium. With the printing position adjusting mechanism, the period of time, between the detection of the leading edge of the continuous sheet and outputting of the predetermined signal, is adjustable. The apparatus starts printing upon receiving the predetermined signal which is outputted after a predetermined time has elapsed after the leading edge of the continuous sheet is detected.

13 Claims, 4 Drawing Sheets

PRINTING POSITION ADJUSTMENT MECHANISM FOR PRINTER

BACKGROUND OF THE INVENTION

The present invention relates to a writing start position adjustment mechanism employed in a printer for adjusting a printing start position on a recording medium.

Conventionally, various printers are known such as ones utilizing a heat sensitive transfer or, an electrophotographic system (laser beam printer etc.) and the like as a printer for printing characters or figures outputted from a computer or word processor.

Among them is a printer which prints figures (or prints characters) on a continuous form recording medium, having feed holes, referred to as a so-called fanfold paper (hereinafter, simply abbreviated as a continuous sheet).

The continuous sheet has a perforated tear line at each of the folded portions thereof, so that it can easily be cut off.

The continuous sheet on which the image has been printed is cut off along the perforated tear line for use in accordance with its need. Thus, a printer for printing images on the continuous sheet is preferably arranged in such a manner that it recognizes the perforated tear line by some methods, and starts printing at a position spaced apart from the perforated tear line by a predetermined distance.

FIG. 4 shows an example of a laser beam printer for printing images on a continuous sheet utilizing an electrophotographic image forming process.

The laser beam printer has a toner cleaner 2, a discharging unit 3, charging unit 4, scanning optical system 5 for introducing a scanning laser beam onto a photoconductive drum 1, developing unit 6, and a transferring unit 7 disposed, respectively, around the photoconductive drum 1 along the rotational direction thereof in a predetermined order, and further, a fixing unit 8 is disposed at a position toward which the continuous sheet 9 is fed, and a tractor 10 for feeding and driving the continuous sheet 9 is disposed in the feed path through which the continuous sheet 9 is fed from the photoconductive drum 1 to the fixing unit 8.

The surface of the photoconductive drum 1 is scanned (exposed) by a laser beam emitted from the scanning optical system 5 in the axial direction of the photoconductive drum 1 (main scanning). The photoconductive drum 1 is rotated (auxiliary scanning), and a latent image is formed on the circumferential surface of the photoconductive drum 1. The latent image is developed by the development unit 6 forming a toner image, and the toner image is transferred onto the continuous sheet 9 by the transfer unit 7. Then the transferred toner image is fixed on the continuous sheet 9 by the fixing unit 8, after which the continuous sheet is ejected.

The tractor 10 is arranged in such a manner that a pair of endless belts 11, each of which has projections engaging the feed holes, defined along respective side edge of the continuous sheet 9 at predetermined intervals, are rotatably stretched between two pulleys 12, 13 with the circulating track on the upper side thereof coinciding with the feed path of the continuous paper 9. These endless belts 11 are disposed in parallel to each other in correspondence to the feed holes defined along the opposite side edges of the continuous sheet 9.

One of the pulleys 13 is connected to a not shown motor as a driving means so that the endless belts 11 are driven at a speed synchronously with the peripheral speed of the photoconductive drum 1. Further, a feed position sensing mechanism 20 is connected to the other pulley 12.

The feed position sensing mechanism 20 comprises a disc plate 21 having slits 21A defined from the center to the outer circumference thereof, and rotated synchronously with the drive of the tractor 10, and a photosensor 22. The photosensor 22 includes a light emitting member and light receiving member. The light emitting member of the photosensor 22 and the light receiving member of the photosensor 22 are oppositely arranged defining a sensing region through which the slits 21A of the disc plate 21 pass upon rotation of the disc plate 21. Thus, a pulse signal is outputted each time the slits 21A pass through the sensing region of the photosensor 22. As described above, since the disc plate 21 rotates synchronously with the rotation of the tractor 10, the pulse signal is outputted synchronously with the drive of the tractor 10, i.e., the feeding amount of the continuous sheet 9.

A leading edge sensing mechanism 30 for sensing the leading edge of the continuous sheet 9 is provided with the feed path of the continuous sheet 9 extending from the tractor 10 to the fixing unit 8.

The leading edge sensing mechanism 30 is arranged in such a manner that an end of a swingable lever 31 is disposed at the position where it interferes with the continuous sheet feed path. A photosensor 32 is provided to sense the other end of the lever 31 on any one side of the swinging range thereof (in the figure, the photosensor senses the leading edge of the continuous sheet 9 when the lever 31 is kicked by the continuous sheet 9, i.e. when a signal is interrupted). When the continuous sheet 9 is located at the position corresponding to the leading edge sensing mechanism 30, the lever 31 is operated to rock by the continuous sheet 9. A signal from the photosensor is interrupted thereby, so that it is sensed that the continuous sheet 9 is present at the position.

In the above arrangement, when the continuous paper 9 is loaded in the laser beam printer, it is set to the tractor 10 with the leading edge thereof located between the tractor 10 and the leading edge sensing mechanism 30. Then, the continuous sheet 9 is fed, and thus, the position of the continuous sheet 9 is recognized through the leading edge sensing mechanism 30 which senses the leading edge of the continuous sheet 9. Thereafter images can be printed from the predetermined position (printing start position) of the continuous paper by counting signals from the feed amount sensing mechanism 20.

More specifically, when the continuous sheet 9 is set, the leading edge position thereof is detected. Thereafter the printing of the images is carried out by recognizing the position of the continuous sheet 9 (the position of the perforated tear line) based on the position of the feed holes thereof (based on the signals from the feed position sensing mechanism 20).

Nevertheless, since the positional accuracy of the feed holes of the continuous sheet is not so high, and further, the sheet is elongated or shortened by the circumferential environments such as humidity and the like, when images are printed depending upon the leading edge of the continuous sheet 9 and the position of the feed holes, a problem arises in that positions from which the images are printed vary in the sheet feed direction. This problem may be overcome to some degree by accurately detecting the position of the continuous sheet, but since mechanical errors of parts may be accumulated, it is very difficult to greatly improve the sensing accuracy and thus the improvement thereof has been desired.

SUMMARY OF THE INVENTION

It is therefore an object of the present invention to provide an improved printing start position adjustment mechanism capable of reducing the variances of the printing positions from which images are printed by enabling a feed sensing mechanism to be adjusted to a position in which the feed sensing mechanism is capable of recognizing the positional relation between the leading edge of a continuous sheet and feed holes with a high accuracy.

For the above object, according to the present invention, there is provided a printing position adjusting mechanism, employed in an image forming apparatus for adjusting a printing position of an image on a recording medium, said apparatus, comprising a means for detecting a leading edge of said recording medium. The mechanism comprises:

device for outputting a predetermined signal synchronously with the feeding of the recording medium, wherein the apparatus starts printing upon receiving the predetermined signal; and means for adjusting the period of time when the device for outputting the predetermined signal starts outputting the signal after the leading edge of the recording medium has been detected.

Optionally, the image forming apparatus comprises a feed mechanism for feeding the continuous sheet. The device for outputting a predetermined signal outputs the predetermined signal synchronously with feeding performance of the feed mechanism.

Further, optionally, the device for outputting a predetermined signal comprises a light transmitting type photosensor device and a disk member rotated synchronously with the feeding of the recording medium. The disk member has a plurality of slits defined by its radius. The said photosensor device detects the slits and outputs a pulse signal.

Further, the plurality of slits defined on the disk member are arranged at predetermined angular intervals, whereby a pulse signal is outputted by the photosensor device, the number of pulses included in the pulses signal corresponding to the feeding amount of the recording medium.

Furthermore, the device for adjusting the period of time comprises a slidably arranged mounting device for mounting the photosensor device. The mounting device is slidably adjusted in the direction to a point where the photosensor device detects the slits being changed to upstream or downstream side with respect to the rotation of the disk member. Thus, the period of time between when the leading edge of the continuous sheet has been detected and the predetermined signal is outputted is changed by sliding the mounting device.

Still further, the mounting device can be arranged to be in a substantially linear direction.

Furthermore, the recording medium is a continuous form recording sheet having perforated tear lines at predetermined intervals.

DESCRIPTION OF THE ACCOMPANYING DRAWINGS

DESCRIPTION OF THE EMBODIMENTS

Figure 1:
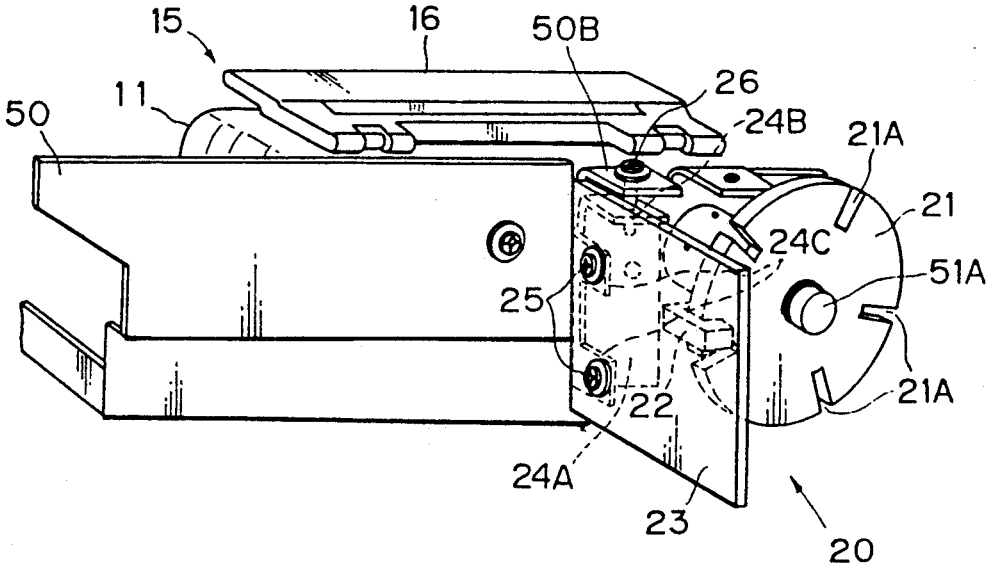
FIG. 1 is a partial perspective view of a tractor portion for feeding a continuous sheet employing a printing start position adjustment structure according to the present invention.
Figure 2:
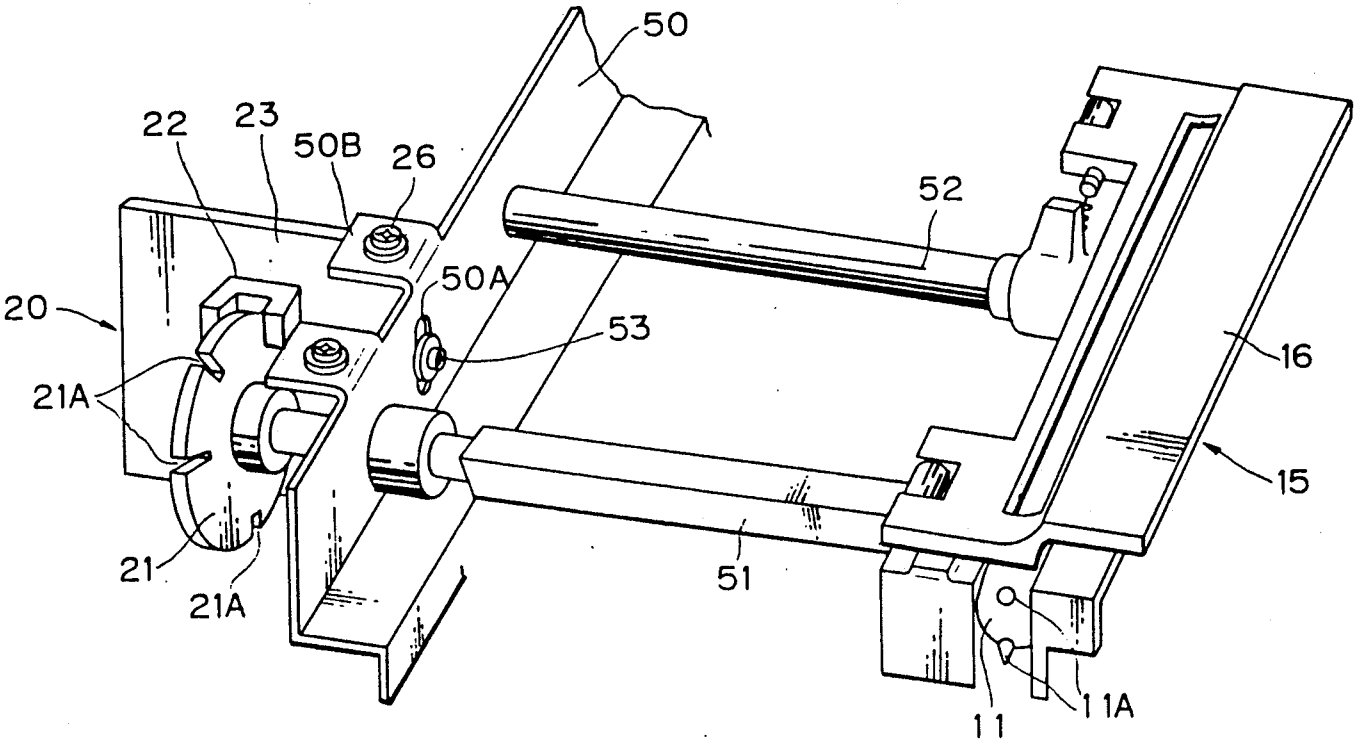
FIG. 2 is a partial perspective view thereof viewed from a different direction.

FIG. 1 is a partial perspective view of a tractor portion for feeding a continuous sheet employing a printing start position adjustment structure according to the present invention. FIG. 2 is a partial perspective view thereof viewed from a different direction.

A tractor 10 comprises a pair of shafts 51 and that are 52 rotatably fitted in parallel at a predetermined interval to frames 50 on the front and rear sides thereof. The frames 50 are provided on the right and left, as shown in FIG. 2 (only one of them is shown). Tractor units 15 are slidably and movably engaged with the pair of shafts 51, 52.

The portion engaged with the tractor unit 15 of one of the shafts 51 is a square shaft having a square cross section and rotatably supported by the frames 50. The shaft 51 is connected to a motor as a driving source at the other end thereof, not shown, and rotatably driven by the motor.

The other shaft 52 is a cylinder shaft and fixed to the frames 50.

The tractor unit 15 comprises a pair of tractor belts 11, each of which has projections 11A engaging with the feed holes defined along respective side edges of a continuous sheet 9. The tractor belts 11 are trained around a pulley (not shown) that is engaged with the square shaft 51 and a pulley (not shown) rotatably engaged with the shaft 52. Thus, the rotation of the square shaft 51 causes the pulleys to be rotated to drive the tractor belt 11.

Note, a cover 16 is provided for preventing the feed holes of the continuous sheet 9 from being removed from the projections 11A of the tractor belt 11.

A feed sensing mechanism 20 is provided at the end portion 51A of the square shaft 51 and projects to the outside from the frame 50.

The feed sensing mechanism 20 comprises a disc member 21 mounted at the end portion 51A of the square shaft 51, the disc plate 21 having a plurality of slits 21A radially defined from the center to the outer circumference thereof, and a light transmit type photosensor 22 being arranged such that the light emitting member of the photosensor 22 and the light receiving member of the photosensor 22 nip the peripheral end of the disc member 21 for sensing the slits 21A of the disc plate 21. More specifically, when the disc plate 21 rotates and the slits 21A thereof pass through the sensing region defined by the light emitting member and the light receiving member of the photosensor 22, a pulse signal is outputted from the photosensor 22.

The rotation of the disc plate 21 is synchronized with the feeding of the tractor belt 11. Thus the pulse signal, which is outputted from the photosensor 22 when the slits 21A of the disc plate 21 pass through the sensing area, corresponds to a feeding amount (length) of the continuous sheet 9 to be fed by the tractor belt 11. Moreover, if the position of the leading edge (or perforated tear line) of the continuous sheet 9 is determined when the pulse signal is outputted from the photosensor 22, the leading edge (or perforated tear line) of the continuous sheet 9 can be recognized by counting the pulses of the pulse signal outputted from the feed sensing mechanism 20 (photosensor 22) thereafter. More specifically, after a period of time from the output of the pulse signal by the feed position sensing mechanism 20 and after the leading edge of the continuous sheet 9 has been detected by the leading edge sensing mechanism, the position of the leading edge (or perforated tear line) of the continuous sheet 9 can be recognized only by the pulse signal from the feed position sensing mechanism 20.

The photosensor 22 is mounted on a base plate 23 and the base plate 23 is attached to the frame 50 via a fitting 24 so that the surface of the disc plate 21 and the base plate have right angles.

The fitting 24 is formed such that a vertically long rectangular base member 24A has the upper end thereof bent at a right angle to form a screw-adjustment portion 24B, and one side thereof bent at a right angle to form a base plate holding portion 24C.

The base plate 23 is fixedly secured to the base plate holding portion 24C at one end thereof by screws 25. The fitting 24, integrally mounting the base plate 23, is installed to the frame 50 with a screw 53 which passes through the frame 50 from the inside thereof and is threaded into the base member 24A. Note that the through hole 50A of the screw 53, defined to the frame 50, is a slot having a predetermined vertical length.

Further, an adjustment screw 26 is threaded into the screw-adjustment portion 24B, defined at the upper end of the base member 24A. The adjustment screw 26 passes through and engages with an adjustment screw base 50B which, is formed by bending outward, by a predetermined width the upper edge of the frame 50 corresponding to the screw-adjustment portion 24B.

With the above arrangement, when the adjustment screw 26 is rotated by loosening the screw 53 by which the fitting 24 is fixed to the frame 50, the position where the adjustment screw 26 is threaded with the adjustment screw portion 24B is changed enabling the fitting 24 to be vertically moved along the lengthwise direction of the through hole 50A formed in the frame 50 (i.e., to be moved toward and apart from the adjustment screw base 50B).

The base plate 23 and the photosensor 22, mounted on the base plate 23, are accordingly moved vertically as the fitting 24 is moved vertically. More specifically, the photosensor 22 is moved in the tangential direction of the disc member 21. Accordingly, the timing at which the slits 21A are detected, with respect to the position of the continuous sheet 9, is changed.

As described above, there is a predetermined relationship between the timing at which signals are outputted from the photosensor 22 and the position of the leading edge (or perforated tear line) of the continuous paper 9. The relationship can be changed by rotating the adjustment screw 26 to move the position of the photosensor 22.

As constructed above, the period of time when the pulse signal is outputted from the feed sensing mechanism 20, after the leading edge of the continuous sheet 9 has been detected by the leading edge sensing mechanism (which means that the leading edge of the continuous sheet 9 is at a predetermined position) can be changed. The printing is executed in accordance with the signal outputted from the feed sensing mechanism 20. Thus, the position from which the images are printed can be adjusted. In other words, this construction allows shifting the phase of the pulse signal to change the predetermined position.

Figure 3:
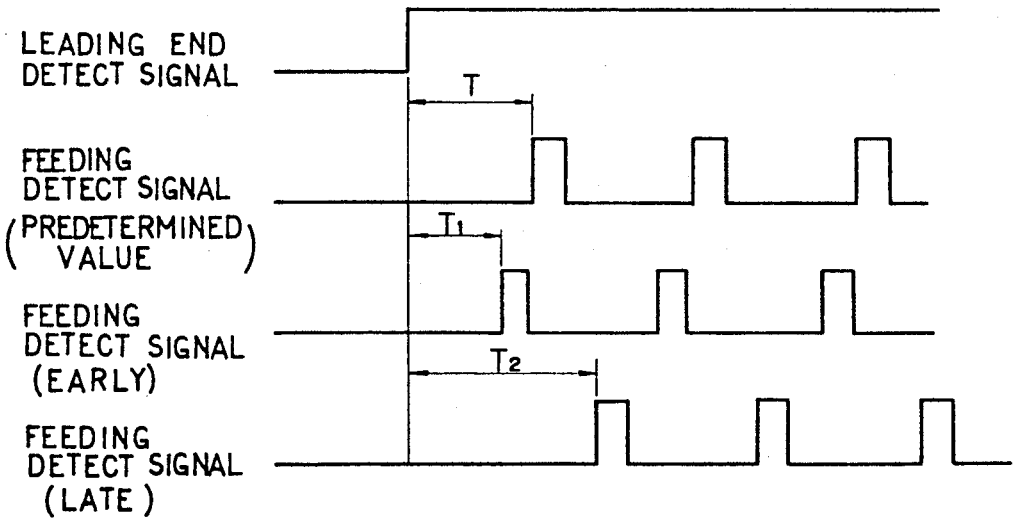
FIG. 3 is a time chart illustrating the adjustment of a writing start position.
Figure 4:
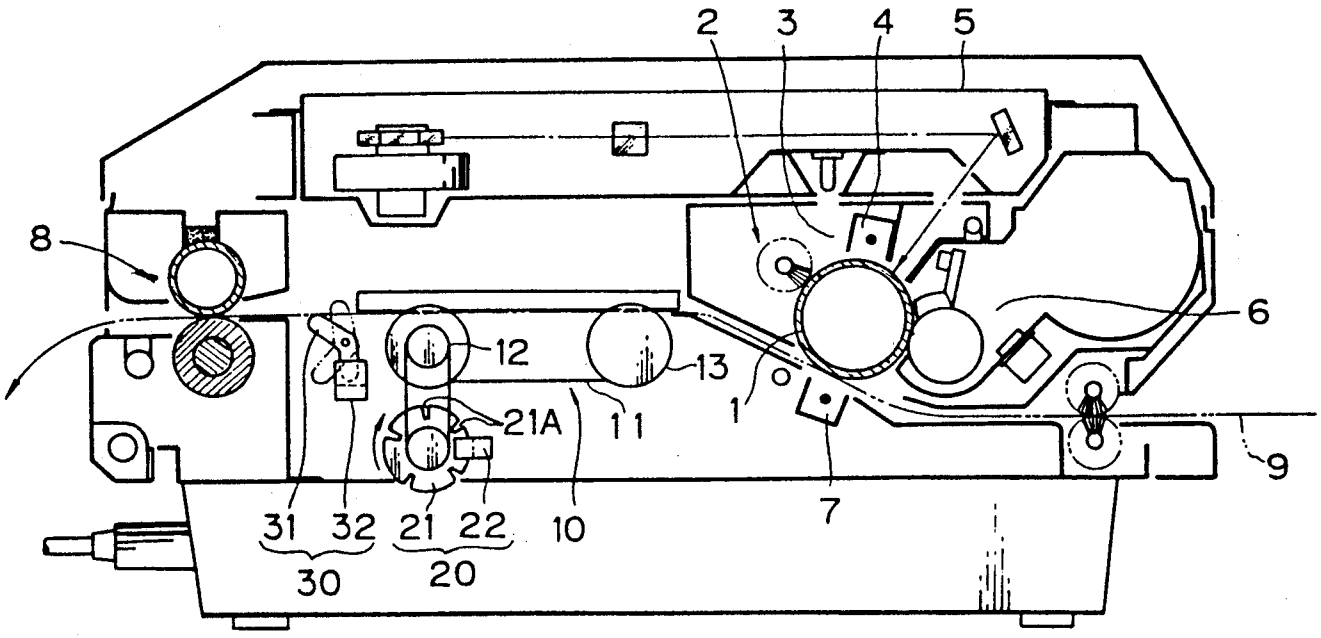
FIG. 4 is a schematic side view of an example of a laser beam printer.

FIG. 3 shows a time chart illustrating the adjustment of the start of printing. The printing of images can be started from the appropriate position as follows: a predetermined time T is preset, the predetermined time T being a period of time to elapse from the leading edge of the continuous sheet 9 being detected by the leading edge sensing mechanism to a signal being outputted from the feed sensing mechanism 20. The predetermined time T is needed to start the printing from an appropriate position on the continuous sheet 9. The feed sensing mechanism is adjusted so that a time T1 or T2, which actually elapses from the leading edge of the continuous sheet 9, has been detected by the not shown leading edge sensing mechanism signalling by the feed sensing mechanism 20, which is equal to the predetermined time T.

As described above, according to the printing start position adjustment mechanism for a printer of the present invention, a timing of a signal, which is outputted from the feed sensing mechanism with respect to the position of a continuous sheet, can be adjusted. By adjusting the signal timing, the feeding condition of the continuous sheet can be recognized with a high accuracy regardless of the accumulated errors of the feed sensing mechanism and the like. The varying of the printing positions in the feeding direction of the continuous sheet can be limited within a predetermined range.

The present disclosure relates to a subject matter contained in Japanese patent application No. HEI 2-94420 (filed on Apr. 10, 1990) which is expressly incorporated herein by reference in its entirety.

What is claimed is:

1. An apparatus for forming an image on a recording medium, said apparatus comprising:

(a) means for feeding the recording medium;

(b) means for generating a pulse signal, the number of pulses of said pulse signal corresponding to the feeding amount of said recording medium;

(c) means for detecting a predetermined position on said recording medium; and (d) means for shifting the phase of said pulse signal in relation to said predetermined position of said recording medium, wherein said means for shifting the phase of said pulse signal comprises means for mounting said means for generating a pulse signal, said mounting means being movable to change the position of said means for generating a pulse signal.

2. The apparatus according to claim 1, wherein said means for generating a pulse signal generates pulses synchronously with the feeding of the recording medium.

3. The apparatus according to claim 2, wherein said means for generating a pulse signal comprises a photosensor means and a disk member rotated synchronously with the feeding of the recording medium, said disk member having at least one slit, said photosensor means detecting said at least one slit and generating said pulse signal.

4. The apparatus according to claim 3, wherein said disk member includes a plurality of slits, said plurality of slits being arranged at predetermined angular intervals.

5. The apparatus according to claim 3, wherein said mounting means is movable to change the position where said photosensor means detects said at least one slit.

6. The apparatus according to claim 5, wherein said mounting means is movable in a substantially linear direction.

7. The apparatus according to claim 6, wherein said substantially linear direction is a substantially vertical direction.

8. The apparatus according to claim 6, wherein said substantially linear direction is tangential to said disk member.

9. The apparatus according to claim 1, wherein said recording medium is a continuous form sheet having tear lines at predetermined intervals.

10. The apparatus according to claim 9, wherein a tear line is at said predetermined position of said recording medium.

11. The apparatus according to claim 1, wherein said means for detecting a predetermined position detects a leading end of said recording medium.

12. The apparatus according to claim 1, wherein said means for shifting the phase includes means for setting a predetermined period of time between the detection of the predetermined position and the generation of a first pulse of said pulse signal.

13. The apparatus according to claim 1, wherein said recording medium is a continuous form sheet having longitudinally spaced feed holes along at least one edge thereof, said means for feeding includes tractor means having projections for engaging respective feed holes, said means for generating a pulse signal generating pulses synchronously with movement of said tractor means.

* * * * *